US010177462B2

(12) United States Patent
Rose

(10) Patent No.: US 10,177,462 B2
(45) Date of Patent: Jan. 8, 2019

(54) BROADBAND FOUR-BAY ANTENNA ARRAY

(71) Applicant: ELECTRONICS RESEARCH, INC., Chandler, IN (US)

(72) Inventor: Robert W Rose, Evansville, IN (US)

(73) Assignee: Electronics Research, Inc., Chandler, IN (US)

( * ) Notice: Subject to any disclaimer, the term of this patent is extended or adjusted under 35 U.S.C. 154(b) by 18 days.

(21) Appl. No.: 15/489,372

(22) Filed: Apr. 17, 2017

(65) Prior Publication Data

US 2017/0302005 A1 Oct. 19, 2017

Related U.S. Application Data

(60) Provisional application No. 62/323,601, filed on Apr. 15, 2016.

(51) Int. Cl.

| | |
|---|---|
| ***H01Q 9/00*** | (2006.01) |
| ***H01Q 21/12*** | (2006.01) |
| ***H01Q 21/00*** | (2006.01) |
| ***H01Q 9/16*** | (2006.01) |
| ***H01Q 21/08*** | (2006.01) |
| ***H01Q 5/335*** | (2015.01) |

(52) U.S. Cl.

CPC ..... *H01Q 21/12* (2013.01); *H01Q 5/335* (2015.01); *H01Q 9/16* (2013.01); *H01Q 21/0006* (2013.01); *H01Q 21/08* (2013.01)

(58) Field of Classification Search

CPC ..... H01Q 21/12; H01Q 5/335; H01Q 21/08; H01Q 9/16; H01Q 21/0006

USPC ..... 343/700 MS, 770, 816, 722, 797, 833

See application file for complete search history.

(56) References Cited

U.S. PATENT DOCUMENTS

| | | | | | |
|---|---|---|---|---|---|
| 4,540,988 | A * | 9/1985 | Munk | H01Q 3/247 | 343/728 |
| 5,812,220 | A * | 9/1998 | Weiss | H01Q 1/246 | 348/723 |
| 5,870,061 | A * | 2/1999 | Casciola | H01Q 13/10 | 343/770 |
| 7,864,119 | B2 * | 1/2011 | Shtrom | H01Q 1/38 | 343/700 MS |
| 8,674,888 | B2 * | 3/2014 | Rofougaran | G06K 7/10237 | 343/722 |
| 2007/0008236 | A1 * | 1/2007 | Tillery | H01Q 21/30 | 343/797 |
| 2008/0079647 | A1 * | 4/2008 | Schadler | H01Q 1/246 | 343/816 |

(Continued)

*Primary Examiner* — Jean B Jeanglaude
(74) *Attorney, Agent, or Firm* — C. Richard Martin; Martin IP Law Group

(57) ABSTRACT

A broadband multi-bay antenna array comprising an upper antenna element group and a lower antenna element group. Each of the upper antenna group and lower antenna group comprises a pair of antenna elements separated by a distance of one-half wavelength at mid-band wavelength. Radiating elements of the first antenna in each pair are positioned in a first orientation and radiating elements of the second antenna in each pair are positioned in a second orientation which differs from the orientation of the first antenna by 180 degrees (flipped over). A center feed input port is positioned between the upper antenna element group and the lower antenna element group and is electrically coupled to each of the first, second, third and fourth antenna elements.

18 Claims, 7 Drawing Sheets

(56) References Cited

U.S. PATENT DOCUMENTS

| | | | | |
|---|---|---|---|---|
| 2009/0009405 | A1* | 1/2009 | Rofougaran | G06K 7/10237 343/700 MS |
| 2011/0181484 | A1* | 7/2011 | Pettus | H01L 23/66 343/833 |
| 2013/0154803 | A1* | 6/2013 | Koch | G06K 7/10356 340/10.1 |

* cited by examiner

BROADBAND FOUR-BAY ANTENNA ARRAY

BACKGROUND OF THE INVENTION

The present invention relates to broadband FM antenna arrays. More particularly, the present invention relates to a broadband 4-bay antenna array capable of being an FM frequency-independent antenna.

SUMMARY OF THE INVENTION

It is a primary objective of the present invention to provide an antenna concept which demonstrates that a broadband FM antenna can be economically built and deliver performance comparable with an single input feed harness using Rototiller® style elements. A further objective is to show that a match of 1.15:1 VSWR (worst case) can be obtained while radiating an ideal relative field, vertically and horizontally polarized azimuth pattern and elevation pattern over the entire 20 mHZ FM band.

The present invention meets these objectives while controlling fabrication cost and enhancing performance. The antenna according to the present invention incorporates numerous features. Two basic Rototiller® brass dipole arm sizes, at 1¾" dia. and 3⅛ dia. mounted to a support stem will produce low power and high power antenna arrays, respectively. Internal to the dipole arm, the first of several compensating stubs are used to control and improve impedance bandwidth. Additionally, there are other unique features that reduce construction cost and enhance performance.

According to one presently preferred embodiment of the invention, there is provided a broadband multi-bay antenna array comprising an upper antenna element group and a lower antenna element group to produce a basic four radiating-element broadband antenna. Each of the upper antenna group and lower antenna group comprises a pair of antenna elements separated by a distance of one-half wavelength at mid-band wavelength. Radiating elements of said first antenna in each pair are positioned in a first orientation and radiating elements of said second antenna in each pair are positioned in a second orientation which differs from the orientation of the first antenna by 180 degrees (flipped over). A center feed input port is positioned between the upper antenna element group and the lower antenna element group and is electrically coupled to each of the first, second, third and fourth antenna elements. The fourth antenna element may be positioned adjacent to and a distance of one-half wavelength at mid-band wavelength from the second antenna element such that all four radiating elements are one half wavelength apart.

A rigid feed harness may be provided which connects the center feed input port to each of the first, second, third and fourth antenna elements. The rigid feed harness includes an upper feed line having a first end connected to the center feed input port and a second end connected to the upper antenna element group at an upper bay element shunt point, and a lower feed line having a first end connected to the center feed input port and a second end connected to the upper antenna element group at a lower bay element shunt point. The rigid feed harness may further comprise an upper shorted external stub element having a first end connected to the upper bay element shunt point and a second free end; and a lower shorted external stub element having a first end connected to the lower bay element shunt point and a second free end. The upper shorted stub element and lower shorted external stub element are preferably tuned to behave constructively in controlling the element arm locus impedances. The rigid feed harness may further include a first feed stub having a first end connected to the upper bay element shunt point and a second end connect to the first antenna element; a second feed stub having a first end connected to the upper bay element shunt point and a second end connect to the second antenna element; a third feed stub having a first end connected to the lower bay element shunt point and a second end connect to the third antenna element; and a fourth feed stub having a first end connected to the lower bay element shunt point and a second end connect to the fourth antenna element.

Each of the first, second, third and fourth feed stubs preferably include a co-axial stub having a first feed end and a second substantially T-shaped end having first and second opposing arm attachment points; and first and second antenna element arms attached to the co-axial stub at the first and second opposing arm attachment points, respectively.

Each of the first and second antenna element arms may include a central feed port connected to the co-axial stub; a first element arm extending away from the central feed point in a first direction; and a second element arm extending away from the central feed point in a second direction. The second direction is substantially opposite of the first direction. An impedance compensating component may be integrated into the second element arm. The impedance compensating element may be formed from a thermoplastic material, or from a thermoplastic polyetherimide (PEI) resin.

For fine tuning in specific tower environments, first and second tip extenders may be removably affixed to the ends of each of the first and second element arms, respectively. Several tip extenders of differing lengths may be provided. The first and second tip extenders may include large round corona balls on the ends thereof.

An eight bay antenna array may be provided by combining first and second broadband multi-bay antenna arrays. A secondary center feed input port connects to and feeds the center feed input ports of the first and second broadband multi-bay antenna arrays. Similarly, a sixteen-bay antenna array may be provided by combining two eight-bay antenna arrays. In this sixteen-bay embodiment, third and fourth broadband multi-bay antenna arrays are provided, each having a secondary center feed input port which connects to and feeds the center feed input ports of the third and fourth broadband multi-bay antenna arrays. A tertiary center feed input port connects to and feeds the secondary center feed input ports.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which.

DETAILED DESCRIPTION OF THE INVENTION

Figure 1A:
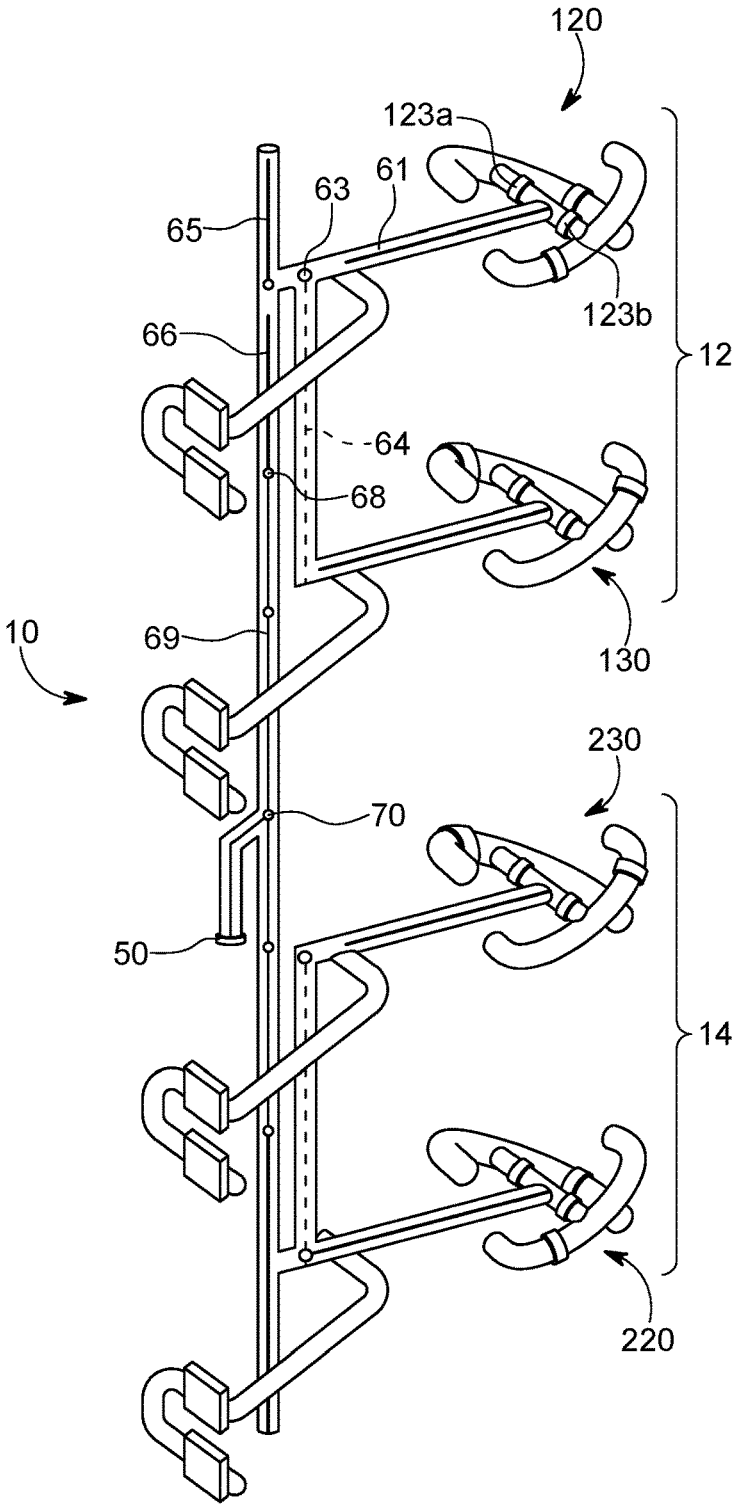
FIG. 1A is a perspective view of the broadband four-bay antenna array according to a presently preferred embodiment of the invention.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

Referring now to FIG. 1A, one preferred embodiment of the present invention is a basic broadband four-bay antenna array 10. The array 10 includes an upper 2-bay element group 12 consisting of a first (upper) antenna element 120 having a normal element orientation (insulators oriented on the downward portion of the arms) and a second (lower) antenna element 130 having a flipped orientation (insulators oriented on the upward portion of the arms). The array 10 also includes a lower 2-bay element group 14 consisting of a third (lower) antenna element 220 having a normal element orientation (insulator down) and a fourth (upper) antenna element 230 having a flipped orientation (insulator up). The lower group 14 is essentially a mirror image of the upper group 12, with orientation of the first (upper) element 120 and third (lower) element 220 being the same while the orientation of the second (lower) element 130 and fourth (upper) element 230 are also the same. As long as the elements of the lower group 14 are a mirror image of the upper group 12, the orientation of the elements themselves may be reversed such that the the first (upper) element 120 and third (lower) element 220 there are flipped (insulator up), while the orientation of the second (lower) element 130 and fourth (upper) element 230 are normal (insulator down).

The elements 120, 130, 220, 230 are spaced a half wavelength apart at mid-band wavelength (i.e. 60" at 98 MHz). By spacing the antenna elements 120, 130, 220, 230 a half wavelength apart with a standard center feed input port 50, elements will become electrically 180 degrees out-of-phase. To correct this out-of-phasing and to place elements in-phase, elements 130, 230 are rotated to be up-side-down. The reason for the flipped end element arrangement stems from the need to have all elements radiate in-phase with equal power despite a physical, half waves spacing of elements. The equal phase and power distribution between elements assures no distortion of the vertical radiated field pattern when operated over the entire FM band.

The 4-bay array 10 is fed by a unique rigid feed harness as best shown in FIG. 1A. Integrated into the feed harness is an optimized custom feed circuit that provides operation over the full FM band. The harness construction delivers the necessary phase and magnitude voltage signal to each element 120, 130, 220, 230 for high efficiency radiation. The harness coaxial sizes can vary appropriately to provide greater power handing capability. The harness internal conducting arrangement of transformers and reactance canceling stubs enhances the match characteristics of the radiating elements.

To extend the 4-bay system input match beyond that furnished by a single element, the physical orientation of elements are altered and corrective reactance measures are taken. From each element arm feed, through the complete feed system "harness", the element's load impedance curl or locus of points undergoes refinement by implementing a series of various types of coaxial stubs. The stubs, when placed correctly within the harness cause unwanted reactance to cancel out tightening the impedance curl.

Figure 1B:
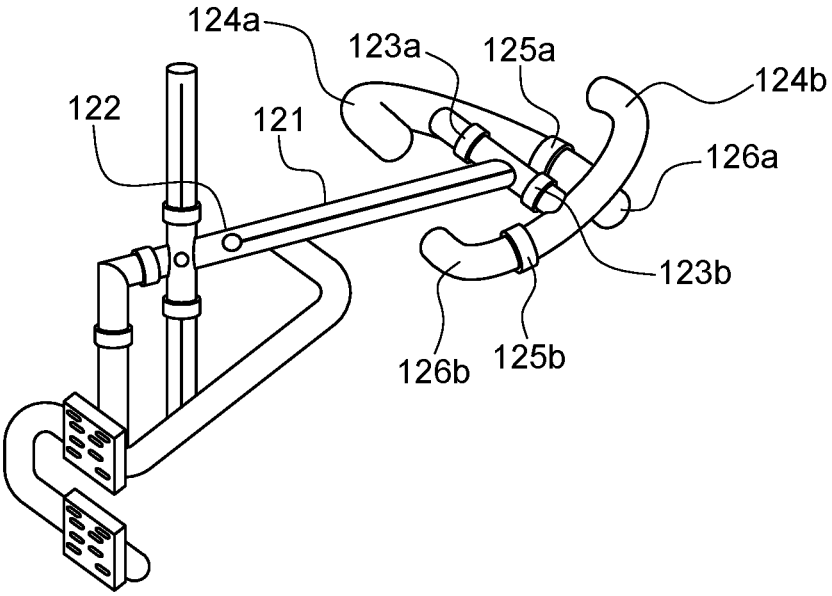
FIG. 1B is a perspective view of the upper antenna element 120 of the upper antenna bay 12 of the four-bay antenna array shown in FIG. 1A.

As best shown in FIG. 1A and FIG. 1B, a stem transformer 61 provides the transformation of the element arms common attachment points 123*a*, 123*b* to the bay element shunt point 63. In a preferred feed scheme according to the invention, a 100 Ohm load from each bay element is presented to the bay element shunt point 63 therefore creating a 50 Ohm match by parallel summation. To improve bandwidth an interconnecting 100 Ohm $Z_o$ coax section 64 is used to preserve the 100 Ohm load of the second antenna element 130 in the two-bay element group 12.

A shorted, external stub 65 is placed at the bay element shunt point 63 where the two elements intersect and impedance summation occurs. The stub's characteristic impedance and length is chosen to maximize reactance canceling and help vector the load impedance into a favorable state. Staging this impedance in this way enhances further measures to reduce the size of the impedance curl. The special, external parallel reactance stub 65 is tuned to behave constructively in controlling the element arm locus impedances (i.e. arm load). By staging or vectoring the "arm load" to a constructive transmission point enables a more effective reduction of an impedance locus by stubs 61, 65 and 66.

The impedance clustering gained from reactance canceling stub 64 and by external stub 65 the impedance is further reduced by rotating the antenna elements one quarter wave towards the generator 68. This reduction is due to the wavelength dispersion acting on each impedance point. At this new location, a final impedance reduction or collapse is obtained by the canceling of reactance from stub 66, which is coaxially nested within the inner confinement of the coax transformer. The impedance locus created by stub 66 is transformed from approximately 50 Ohms to 100 Ohms by the influence of a two stage coaxial transformer 69. The 60 inch length of this transformation (half wave length at mid band FM) supplements the curling effect of the impedance. The resulting complex impedance, once transformed, is combined through the use of simple tee combiner with the mirrored lower two bay having undergone the same procedure. The result is to provide an input load that is nearly 50 Ohms across the entire FM band at point 70.

As best shown in FIG. 1B, the upper or first antenna element 120 includes a co-axial tee 121 having a first feed end 122 and a second substantially T-shaped end having opposing arm attachment points 123*a*, 123*b*. Antenna element arms 124*a*, 124*b* are attached to the co-axial tee 121 at the respective attachment points 123*a*, 123*b*. Insulators, used as impedance compensating elements 125*a*, 125*b* are integrated into the element arms 124*a*, 124*b*, respectively. The impedance compensating elements 125*a*, 125*b* allow each dipole arm 124*a*, 124*b* to create a potential difference between its outer perimeter halves and excite the element arm for radiation. The impedance compensating elements 125*a*, 125*b* use a wide dipole insulating barrier that offers protection in harsh environments. Preferably, a thermoplastic (PEI) material is used that is heat and flame resistance and has a high dielectric strength. Alternatively, injection molded amorphous thermoplastic polyetherimide (PEI) resins, such as ULTEM™ plastic, is chosen for the insulator material due to its superior electrical and mechanical properties (i.e. withstands high RF power and will not degrade from ultra violet light).

Imbedded, reactance cancelling stubs use Teflon™ as a solid dielectric material that offers the benefit of a full quarter-wave transformer at a fraction of length. Associated with the Teflon™ material is high voltage breakdown capability. The imbedded stubs possess the ability to vector an impedance curl by varying their inter-most length.

The two asymmetric radiating arms 124*a*, 124*b* may include tip extenders 126*a*, 126*b* which have a threaded end for engaging a threaded end of the impedance compensating elements 125*a*, 125*b*. In this way, the tip extenders 126*a*, 126*b* can be quickly and easily attached to and removed from the radiating arms 124*a*, 124*b*. Tip extenders of differing lengths can be provided for purposes of fine tuning the antenna for specific tower environment conditions. Additionally, specific frequency or group of frequencies can be singled out of the FM band for optimization by using sets of tip extenders and a fine input tuner. Using such equipment, the antennas matched can be optimized to be below a 1.02:1 VSWR at specific frequencies. This feature maximizes the elements profitability having minimized inventories of frequency specific antenna parts (ie. dipole arms).

Dipole end extenders 126*a*, 126*b* are screw-attached then locked requiring no welding or cleanup after assembly. The series stub inner-conductor provide expansion and contraction control. These antenna arrays are pre-tunable by design and therefore factory assembled antenna arrays, to adjust tuning, is not necessary however, pressurization and match verification is checked. After finishing air check, the antenna can be taken down and put into its shipping container with no additional on-site tuning required after installation.

Figure 1C:
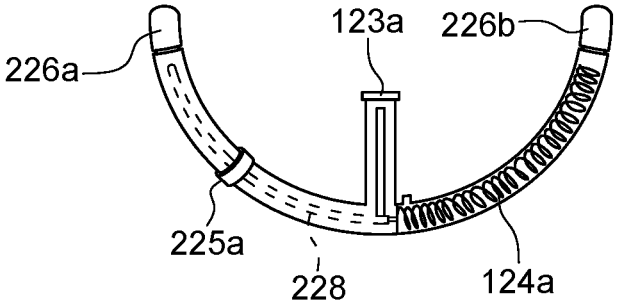
FIG. 1C is a side elevation view of one of the antenna dipole arms of the antenna shown in FIG. 1A and FIG. 1B.
Figure 1D:
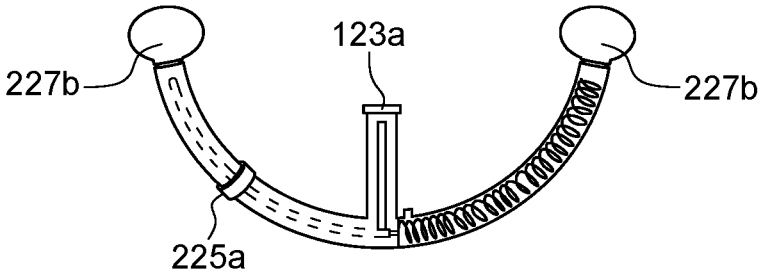
FIG. 1D is a side elevation view of one of the antenna dipole arms of the antenna shown in FIG. 1A and FIG. 1B according to an alternative embodiment showing anti-corona end caps.

The construction of the radiating arm 124*a*, 124*b* and support stem 121 makes it possible to modify the arm to improve its operation over a broader frequency range. A modified arm insulator 225*a* and an anti-corona element arm tips 226*a* are shown in FIG. 1C. The enlarged insulator 225*a* prevents voltage breakdown. Interchangeable tips having large round corona balls 227*a*, 227*b* as shown in FIG. 1D counteract corona-discharge when operating at high power levels in inclement weather.

As shown in FIG. 1C, in each individual element arms 124*a*, the load impedance cluster given by the unique mutual interaction (or influence) of neighboring element arms is further enhanced by a progression of coaxial devices (stubs) imbedded within the feed harness. A reactance canceling stub 228 may be placed in parallel with the arm feed impedance.

The load curl impedance at the arm attachment points 123*a*, 123*b* is vectored into an ideal position enabling the use of steatite ring packets which may be positioned between the outer coaxial conductor and inner conductor along the length of the co-axial tee 121 as simple transformers. A steatite packet on the co-axial tee 121 inner conductor can have the effect of transforming a locus of impedance points to higher impedance levels (i.e. 200 Ohm, 300 Ohm and etc.) at the shunt point. This possible transformer with an amount of Steatite placed advantageously could be used in lieu of various small metal rod transformers.

Figure 1E:
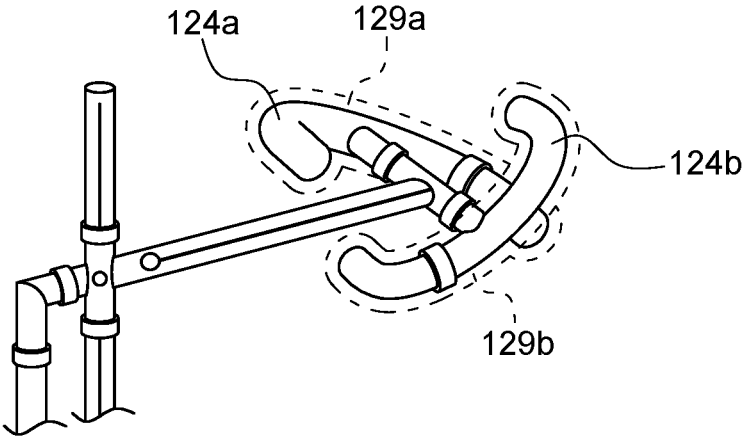
FIG. 1E is a perspective view of a single antenna bay of the four-bay antenna array shown in FIG. 1A show with radomes.

As shown in FIG. 1E, the element arms 124*a*, 124*b* can be encapsulated with radome covers 129*a*, 129*b* to give the element immunity to the detuning from sleet and ice buildup. An adapter insert allows the standard LP Rototiller radome cover to be used.

Figure 5:
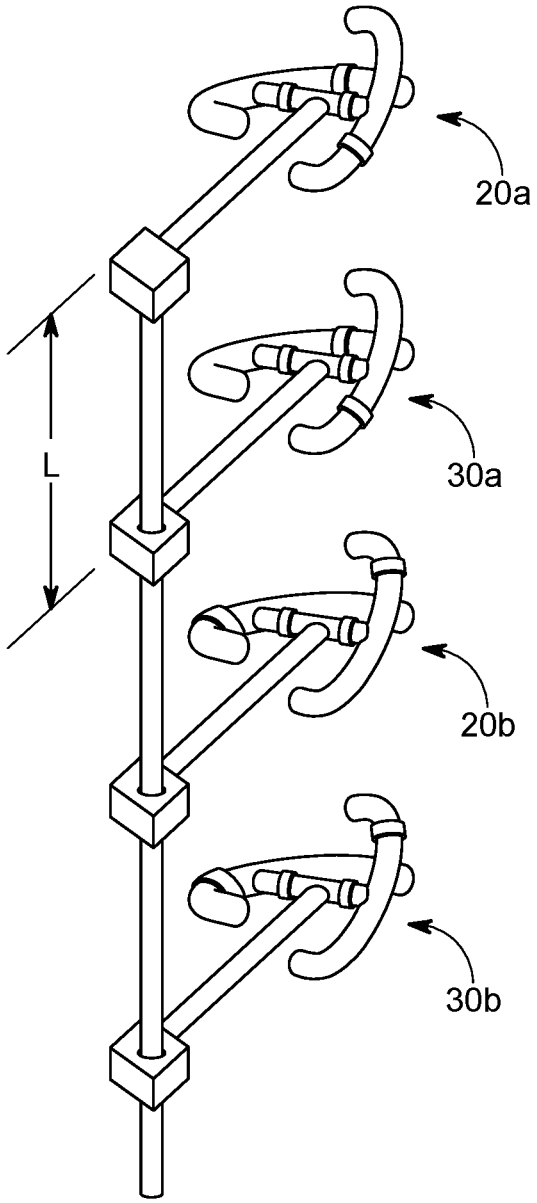
FIG. 5 PRIOR ART
FIG. 5 is a schematic drawing of a prior art antenna where elements are spaced a full physical wavelength apart and fed in phase.

As shown in FIG. 5, the prior art teaches that normally adjacent antenna elements 20*a*, 30*a* are interconnected or shunted across a common transmission line using full physical wavelength L between the antenna elements 20*a*, 30*a* and are fed in phase. This full wave spacing effectively places the elements electrically in parallel, feeding each element with a signal of equal voltage and proper phase such that the signals add vectorially. Prior art antennas of this sort have all elements 20*a*, 30*a*, 20*b*, 30*b* in the same orientation regarding positioning of the dipole arms.

Figure 2:
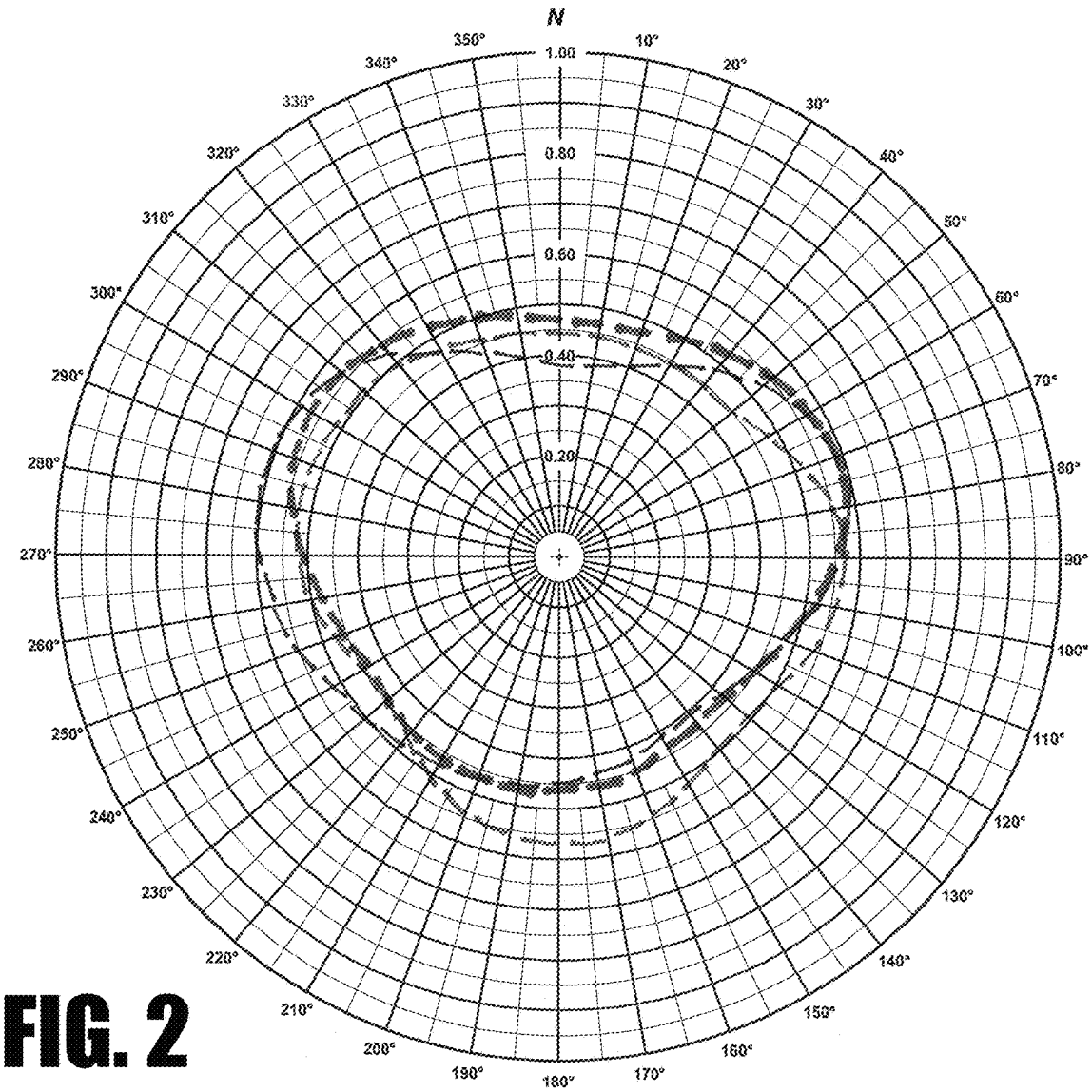
FIG. 2 is a plot illustrating little difference between operating frequencies within the FM band with respect to horizontal field patterns of the present invention.

As best shown in FIG. 1A, by reducing the spacing to ½ wavelength (½ L), elements 130, 230 must be flipped to correctly place elements back in electrical phase with elements 120, 220. As a consequence of interconnecting half-wave spaced elements using a center-fed harness, as shown in FIG. 1A, elements are out-of-phase with respect to their neighboring elements. If no action were taken to correct this out-of-phase problem, the wave fronts from each element would propagate out to produce a destructive pattern (null) in the vertical plane towards the radio horizon. This interference property of waves is known as constructive/destructive wave behavior. If the end elements were reversed 180° (flipped) their waves will now travel in-step with other elements, reinforcing one another to create a strong wave in the vertical plane (relative field) towards the horizon thus providing good signal coverage. However, in the vertical plane (relative field) pattern as shown in FIG. 2, the waves will cancel completely. In other words, there will be destructive wave interference between elements related to up and down the support tower therefore, eliminating the signal and limiting RF energy, and subsequent RF exposure to personnel, at ground level in the immediate vicinity of the antenna.

Figure 3:
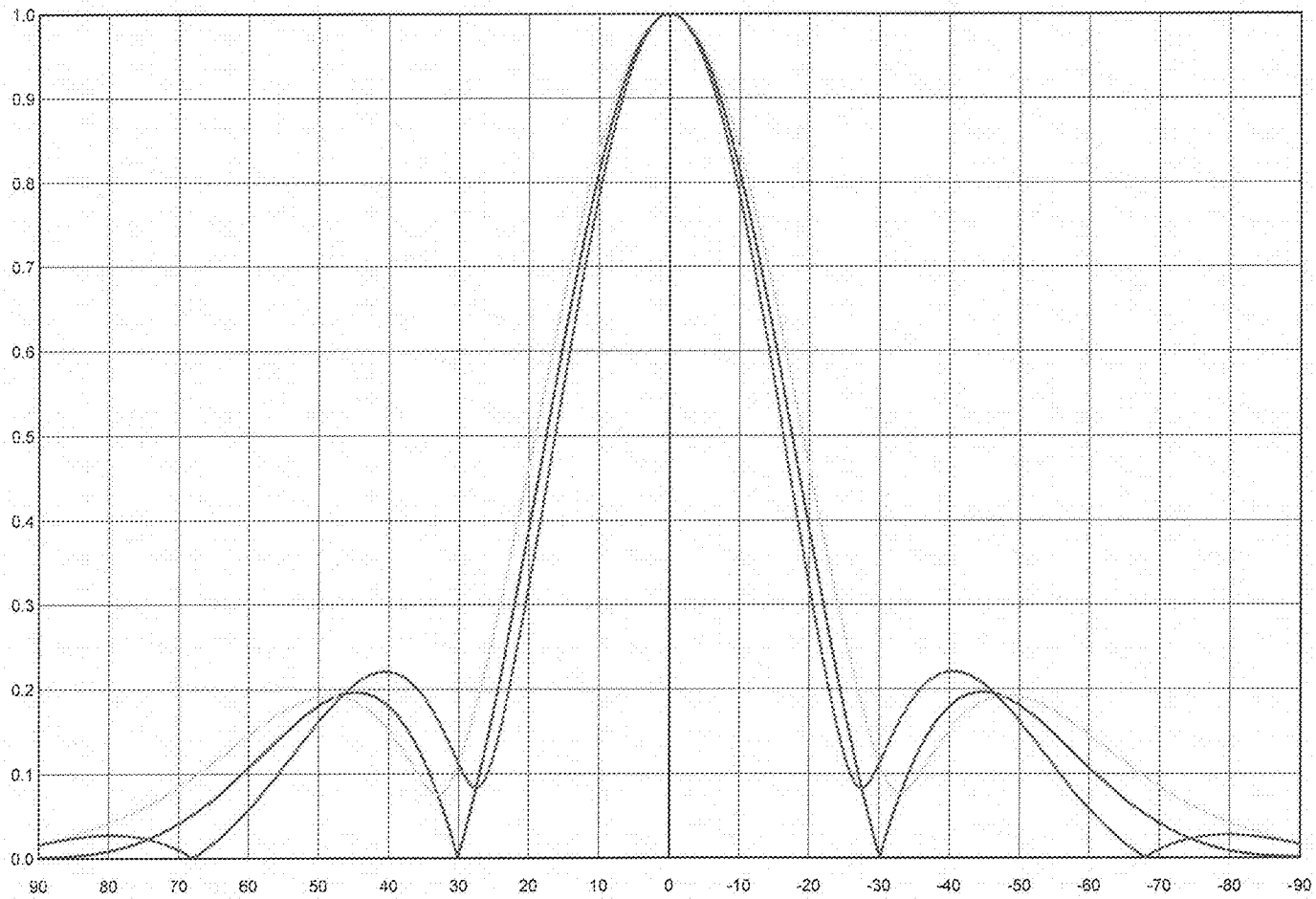
FIG. 3 is a plot illustrating little difference between operating frequencies within the FM band with respect to the vertical elevation pattern of the antenna array of the present invention.

The antenna array 10 of the present invention, relative to conventional antenna designs, offers improved broadband performance due in part to the elements being half-wave spaced at a mid-band FM frequency (i.e. half wave spacing at 98 MHz equals 60 inches) and the unconventional configuration of its flipped elements. As shown in FIG. 2 and FIG. 3, three pattern plots are given representing operating frequencies spaced within the FM band to illustrate the horizontal field pattern (FIG. 2) and its vertical elevation field broadband performance (FIG. 3). The antenna array of the present invention transmits a circular polarized signal (equal horizontally polarized and vertically polarized energy) in the horizontal plane for good vertical and horizontal receiver coverage. Moreover, the antenna array of the present invention delivers a vertical plane pattern that varies only slightly with frequency. This is due to the arrangement of the arrays elements at half wavelength and the feed harness design. The vertical field is uniformly disbursed toward the horizon essentially producing no wasted energy directed vertically upward or downward in the immediate vicinity of the tower. As shown in FIG. 3, the stacking gain varies only slightly over the whole FM band. Both horizontal relative field (H &V) patterns of the array are generally unvarying due to the averaged influence of the support structure with the half wave spaced, and flipped elements.

Figure 4A:
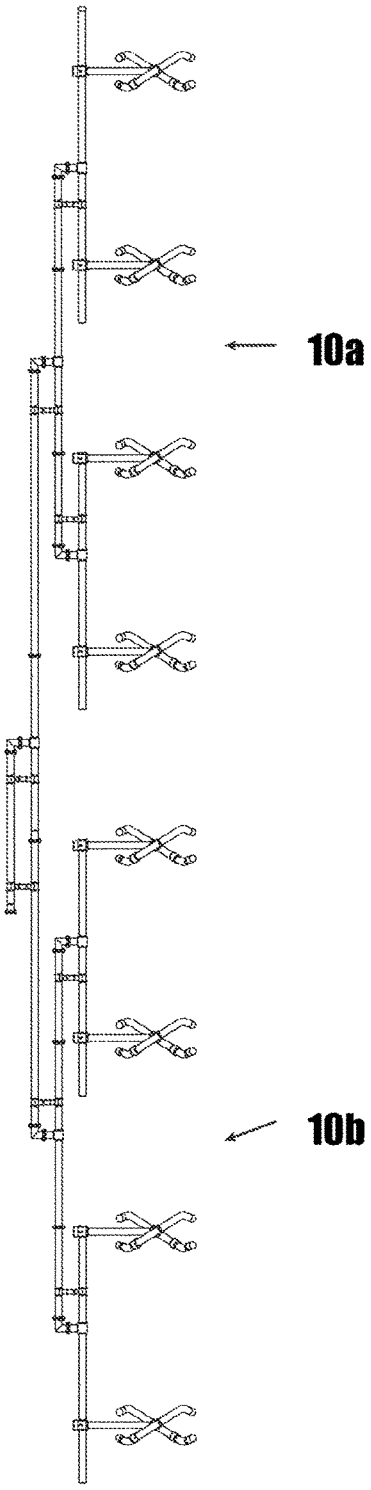
FIG. 4A is a schematic drawing of an 8-bay antenna array according to an embodiment of the invention.
Figure 4B:
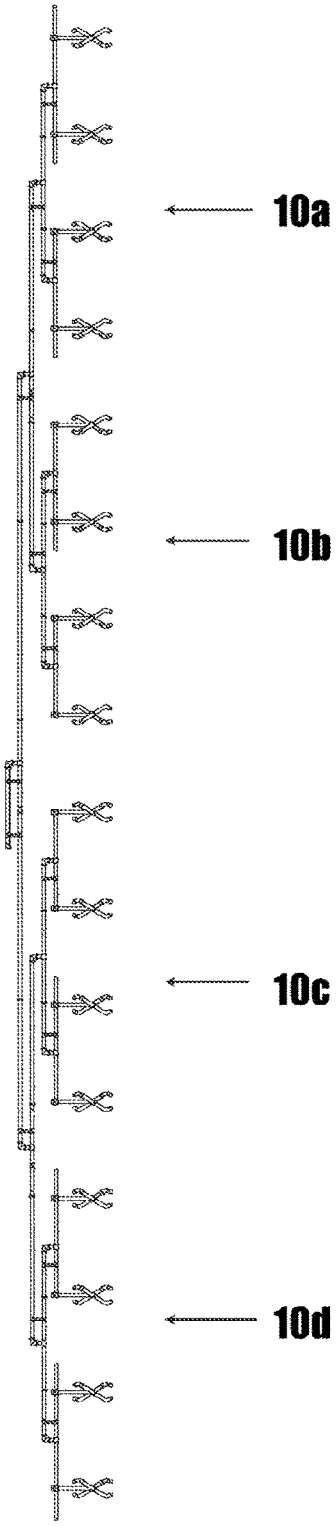
FIG. 4B is a schematic drawing of a 16-bay antenna array according to an embodiment of the invention.

The 4 bay arrangement can be considered as a basic module and used for building larger arrays of elements with proper coaxial feed circuitry (i.e. two 4 bay arrays can be combined, producing 8 bay arrays and 8 bay arrays can be combined producing 16 bay arrays and etc. using alternately flipped elements). To increase signal strength, a pair of 4-bay antenna arrays 10*a*, 10*b* as described above may be combined to achieve an 8-bay antenna array as shown in FIG. 4A to provide higher gain. Similarly, four 4-bay antenna arrays 10*a*, 10*b*, 10*c*, 10*d* may be combined to achieve a 16-bay antenna array as shown in FIG. 4B. In each such instance, the antenna arrays are center-fed as described previously and as shown in FIG. 4A and FIG. 4B.

Compared to other antenna designs, the 4-bay center fed antenna array 10 of the present invention uses an unusual relative element relationship. This non-conventional arrangement has a natural tendency to broadband the element feed points. The present invention provides exceptional broadband performance over the entire FM band; this performance extends to both impedance matching and radiated pattern performance.

A host of broadbanding techniques are implemented. For example, from the feed segment of each dipole arm on throughout the feed harness system, impedance curl reductions are made. The size of the locus of impedance points "curl" is condensed using a variety of distributed tuning elements such as series and parallel stub compensators, two stage transformers, and lump reactive curl impedance compensators.

This detailed description, and particularly the specific details of the exemplary embodiments disclosed, is given primarily for clarity of understanding and no unnecessary limitations are to be understood there from, for modifications will become evident to those skilled in the art upon reading this disclosure and may be made without departing from the spirit or scope of the claimed invention.

I claim:

1. A broadband multi-bay antenna array comprising:

an upper antenna element group comprising a first antenna element and a second antenna element, said first and second antenna elements being separated by a distance of one-half wavelength at mid-band wavelength, wherein radiating elements of said first antenna are positioned in a first orientation and radiating elements of said second antenna are positioned in a second orientation, said second orientation differing from said first orientation by 180 degrees;

a lower antenna element group comprising a third antenna element and a fourth antenna element, said third and fourth antenna elements being separated by a distance of one-half wavelength at mid-band wavelength, wherein radiating elements of said third antenna are positioned in said first orientation and radiating elements of said fourth antenna are positioned in said second orientation; and a center feed input port positioned between the upper antenna element group and the lower antenna element group, said center feed input port electrically coupled to each of said first, second, third and fourth antenna elements.

2. The broadband multi-bay antenna array of claim 1 wherein said fourth antenna element is positioned adjacent to and a distance of one-half wavelength at mid-band wavelength from said second antenna element.

3. The broadband multi-bay antenna array of claim 1 further comprising a rigid feed harness which connects the center feed input port to each of the first, second, third and fourth antenna elements.

4. The broadband multi-bay antenna array of claim 3 wherein the rigid feed harness comprises:

an upper feed line having a first end connected to the center feed input port and a second end connected to the upper antenna element group at an upper bay element shunt point; and a lower feed line having a first end connected to the center feed input port and a second end connected to the lower antenna element group at a lower bay element shunt point.

5. The broadband multi-bay antenna array of claim 4 wherein the rigid feed harness further comprises:

an upper shorted external stub element having a first end connected to said upper bay element shunt point and a second free end; and a lower shorted external stub element having a first end connected to said lower bay element shunt point and a second free end.

6. The broadband multi-bay antenna array of claim 5 wherein the upper shorted stub element and lower shorted external stub element are each one-quarter wavelength in length.

7. The broadband multi-bay antenna array of claim 5 wherein the upper shorted stub element and lower shorted external stub element are tuned to behave constructively in controlling the element arm locus impedances.

8. The broadband multi-bay antenna array of claim 5 wherein the rigid feed harness further comprises:

a first feed stub having a first end connected to the upper bay element shunt point and a second end connect to said first antenna element;

a second feed stub having a first end connected to the upper bay element shunt point and a second end connect to said second antenna element;

a third feed stub having a first end connected to the lower bay element shunt point and a second end connect to said third antenna element; and a fourth feed stub having a first end connected to the lower bay element shunt point and a second end connect to said fourth antenna element.

9. The broadband multi-bay antenna array of claim 8 wherein each of said first, second, third and fourth feed stubs comprise:

a co-axial stub having a first feed end and a second substantially T-shaped end having first and second opposing arm attachment points; and first and second antenna element arms attached to the co-axial stub at said first and second opposing arm attachment points, respectively.

10. The broadband multi-bay antenna array of claim 9 wherein each of said first and second antenna element arms comprises:

a central feed port connected to the co-axial stub;

a first element arm extending away from said central feed point in a first direction; and a second element arm extending away from said central feed point in a second direction, said second direction being substantially opposite of said first direction.

11. The broadband multi-bay antenna array of claim 10 further comprising an impedance compensating element integrated into the second element arm.

12. The broadband multi-bay antenna array of claim 11 wherein the impedance compensating element is formed from a thermoplastic material.

13. The broadband multi-bay antenna array of claim 11 wherein the impedance compensating element is formed from a thermoplastic polyetherimide (PEI) resin.

14. The broadband multi-bay antenna array of claim 11 further comprising first and second tip extenders removably affixed to the ends of each of the first and second element arms, respectively.

15. The broadband multi-bay antenna array of claim 14 wherein several tip extenders of differing lengths are provided.

16. The broadband multi-bay antenna array of claim 14 wherein the first and second tip extenders include large round corona balls on the ends thereof.

17. The broadband multi-bay antenna array of claim 1 further comprising first and second broadband multi-bay antenna arrays each having a secondary center feed input port which connects to and feeds the center feed input ports of the first and second broadband multi-bay antenna arrays.

18. The broadband multi-bay antenna array of claim 17 further comprising:

third and fourth broadband multi-bay antenna arrays each having a secondary center feed input port which connects to and feeds the center feed input ports of the third and fourth broadband multi-bay antenna arrays; and a tertiary center feed input port which connects to and feeds the secondary center feed input ports.

* * * * *